United States Patent [19]

Lancesseur et al.

[11] Patent Number: 4,805,789

[45] Date of Patent: Feb. 21, 1989

[54] PACKAGING TUBE FOR TABLETS, PILLS AND THE LIKE, WITH A RESERVE BOX

[75] Inventors: Francois Lancesseur, Choisy-Le-Roi; Claude Mandin, Neuilly-Sur-Seine, both of France

[73] Assignees: Hoffmann-La Roche Inc., Nutley, N.J.; Air Sec, Choisey-Le-Roi, France

[21] Appl. No.: 162,129

[22] Filed: Feb. 29, 1988

[30] Foreign Application Priority Data

Mar. 13, 1987 [FR] France ..... 8703445

[51] Int. Cl.[4] ..... B65D 1/04

[52] U.S. Cl. ..... 215/6; 206/221; 206/538; 206/540; 220/20; 220/23.86

[58] Field of Search ..... 206/217, 219, 221, 528, 206/538, 540; 220/23.86, 20; 215/6, 10

[56] References Cited

U.S. PATENT DOCUMENTS

| | | | |
|---|---|---|---|
| 378,752 | 2/1888 | Ader | 215/6 |
| 1,615,319 | 1/1987 | Wynn . | |
| 2,374,092 | 4/1945 | Glaser | 215/6 |
| 3,415,361 | 12/1968 | Adams, Jr. et al. | 206/221 |
| 3,920,120 | 11/1975 | Shveda | 206/217 |
| 3,954,179 | 5/1976 | Warmath | 206/528 |
| 4,324,338 | 4/1982 | Beall | 206/217 |

FOREIGN PATENT DOCUMENTS

| | | | |
|---|---|---|---|
| 0167783 | 1/1986 | European Pat. Off. . | |
| 319241 | 3/1902 | France | 215/6 |
| 497688 | 3/1919 | France | 215/6 |
| 2196944 | 3/1974 | France . | |
| 2529865 | 1/1984 | France . | |
| 34758 | 1/1935 | Netherlands | 215/6 |
| 3599 | 4/1918 | United Kingdom | 215/6 |

*Primary Examiner*—David T. Fidei

*Attorney, Agent, or Firm*—Oblon, Fisher, Spivak, McClelland & Maier

[57] ABSTRACT

A packaging tube for compressed tablets, pills and similar products is provided with a bottom cavity which is separated from the container portion of the tube by a partition wall, a removable box being inserted in the cavity in the same manner as an end plug. The removable box is formed by two half-shells which are connected together by means of a flexible tongue. The half-shells cooperate so as to form a closed box by means of a skirt extending from the flat portion of the half-shell which forms the base of the box and by means of a rib carried by the internal face of the flat main portion of the half-shell which forms the lid of the box, the rib being applied against the internal face of the skirt. The closed box can be introduced into the cavity in the same manner as an end-plug or stopper by virtue of the skirt, which is provided with an abutment shoulder.

2 Claims, 1 Drawing Sheet

PACKAGING TUBE FOR TABLETS, PILLS AND THE LIKE, WITH A RESERVE BOX

BACKGROUND OF THE INVENTION.

1. Field of the invention.

This invention relates to a packaging tube for tablets, pills and similar articles.

2. Description of the Prior Art.

Tablets, pills, capsules and the like are often packaged in tubes or vials of glass or of plastic material. By reason of the size or quantity of products involved, the tubes may have substantial dimensions, and patients sometimes feel reluctant to burden themselves with such packages when they have to leave their place of residence for a few hours or even a few days according to the dosage required.

SUMMARY OF THE INVENTION

In order to overcome this disadvantage, the present invention provides a packaging tube of plastic material for tablets, pills and like products. The tube is provided at the bottom end thereof with a cavity which is formed between a partition wall of the tube and the side wall of the tube. The cavity accomodates a removable reserve box forming a bottom end plug.

The removable reserve box is constituted by two half-shells which are joined together by means of a flexible tongue and which are thus permitted to come into oppositely-facing relation in order to close the box.

The half-shell constituting the base of the box has a flat main portion from which projects a vertical skirt the external dimensions of which correspond to the internal dimensions of the tube cavity. A shoulder is abuttingly applied against the extremity of the cavity wall.

The half-shell which constitutes the lid of the box has a flat main portion surrounded by a rib which is sized and shaped to fit in position against the internal wall of the skirt of the base half-shell and by a flange which is adapted to bear on the extremity of the skirt.

DETAILED DESCRIPTION OF THE INVENTION.

Figure 1:
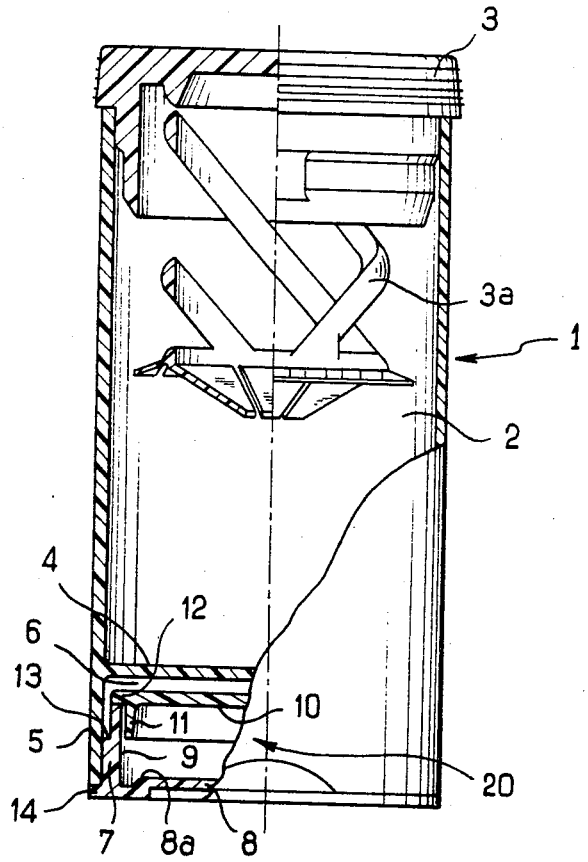
FIG. 1 is a part-sectional view of a packaging tube in accordance with the invention.
Figure 2:
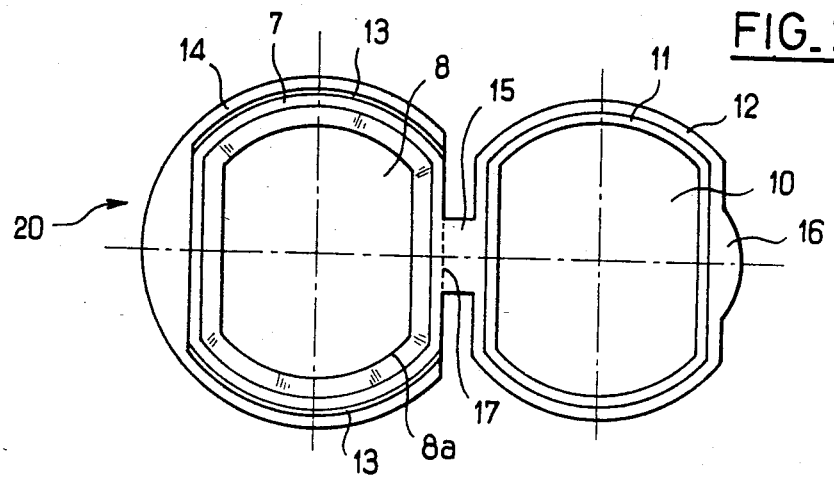
FIG. 2 is a top view of the open box.

A packaging tube 1 according to the invention comprises a cylindrical tube having a container portion 2 which is closed at the top end by means of a conventional stopper 3 and a side wall 5. As shown by way of example in FIG. 1, the stopper 3 can have a flexible appendage 3a for limiting the displacement of tablets within the tube. The side wall 5 of the tube 1 extends beyond a partition wall 4 which closes the container portion 2 so as to form a bottom recess or cavity 6.

The cavity 6 is closed by a bottom end plug which constitutes a removable box. The bottom end plug is composed of two half-shells advantageously joined together by means of a flexible connecting tongue 15. The half-shell which forms the base of the box has a circular contour a part of which is cut along a straight edge which forms a space between the bottom end plug and the cavity wall, thus facilitating removal of the plug. A skirt 7 having an internal face 9 projects from a flat main portion 8. The skirt 7 ensures that the bottom end plug is mounted within the cavity by virtue of its two arcuate portions which are concentric with the cavity and joined together along rectilinear portions which are parallel to the straight edge of the half-shell. The upper portion of the skirt 7 is of slightly smaller thickness in its arcuate portions beyond a shoulder 13. A shoulder 14 is abuttingly applied against the extremity of the side wall 5 of the cavity 6. The flat main portion 8 of the base can have a raised central portion delimited by a line **8*a* which may or may not have the same contour as the skirt 7**, but this is only a constructional detail which does not form part of the invention.

The external contour of the half-shell which forms the box lid has arcuate portions joined to each other by two rectilinear portions, the flexible connecting tongue 15 being located between the rectilinear portion of the base and a first rectilinear portion of the lid. Interengagement of the two half-shells takes place by means of a rib 11 which projects from the internal face of a flat portion 10 of the lid whilst a flange 12 comes into position so as to cover the top portion of the skirt 7. The shape and dimensions of the rib 11 are such that the rib 11 comes into position resiliently aginst the internal face 9 of the skirt 7. On the free rectilinear portion, provision is preferably made for a rounded lug 16 which facilitates opening of the box. A folding line 17 facilitates positioning of the lid against the base by flexural deformation of the flexible connecting tongue 15. When the box is closed, it can be introduced into the cavity 6 in the same manner as a plug or stopper.

When the patient desires to take with him (or her) only a few tablets, he (or she) removes the box from the cavity 6, places the required number of tablets therein, and then only needs to introduce a box of very small size among his (or her) personal effects. In the event of non-utilization, the box is replaced within the cavity 6 in order to prevent it from being mislaid.

The packaging tube is preferably made of rigid plastic, for example in the form of a tube having two open ends and provided with a partition wall which divides the interior into two unequal parts namely, on the one hand the container portion 2 and on the other hand the cavity 6. The stopper 3 can be of any conventional type, whilst the removable box is formed of flexible plastic, for example, in order to permit flexural deformation of the flexible connecting tongue 15.

It is readily apparent that certain details mentioned in the foregoing may be modified without thereby departing either from the scope or the spirit of the invention.

What is claimed is:

1. A packaging tube for tablets, pills and like products wherein:

(a) said packaging tube is provided at the bottom end thereof with a cavity which is formed by a partition wall and the side wall of said packaging tube and which accommodates a removable box forming a bottom end plug;

(b) said removable box comprises two half-shells which are joined together by means of a flexible tongue and are thus permitted to come into oppositely-facing relation in order to close said removable box;

(c) the one of said two half-shells constituting the base of said removable box has a flat main portion from which projects a vertical skirt the external dimensions of which correspond to the internal dimensions of said cavity, a shoulder being abuttingly applied against the extremity of the side wall of said cavity; and (d) the one of said two half-shells constituting the lid of said removable box has a flat main portion surrounded by a rib which is sized, shaped, and positioned to fit against the internal face of said vertical skirt and by a flange which is sized, shaped, and positioned to bear on the top edge of said vertical skirt.

2. A tube according to claim 1 wherein:

(a) said removable box is made of flexible plastic and (b) said flexible tongue is provided with a folding line.

* * * * *